US005286707A

United States Patent [19]

Kushi et al.

[11] Patent Number: 5,286,707

[45] Date of Patent: Feb. 15, 1994

[54] RECORDING MEDIUM FOR SUBLIMATION TYPE HEAT-SENSITIVE TRANSFER RECORDING PROCESS

[75] Inventors: Kenji Kushi; Takayuki Iseki; Tadayuki Fujiwara; Kazuhiko Jufuku, all of Otake, Japan

[73] Assignee: Mitsubishi Rayon Co., Ltd., Tokyo, Japan

[21] Appl. No.: 788,427

[22] Filed: Nov. 6, 1991

[30] Foreign Application Priority Data

Nov. 7, 1990 [JP] Japan ..... 2-301767

[51] Int. Cl.[5] ..... B41M 5/035; B41M 5/38

[52] U.S. Cl. ..... 503/227; 428/195; 428/211; 428/342; 428/537.5; 428/913; 428/914

[58] Field of Search ..... 8/471; 428/195, 913, 428/914, 211, 537.5, 342; 503/227

[56] References Cited

U.S. PATENT DOCUMENTS 4,778,782 10/1988 Ito et al. ..... 503/227

FOREIGN PATENT DOCUMENTS 234563 9/1987 European Pat. Off. ..... 503/227 X 275319 7/1988 European Pat. Off. ..... 503/227

OTHER PUBLICATIONS

Patent Abstracts of Japan, vol. 12, No. 55 (M-669) [2902], Feb. 19, 1988, & JP-A-62-202781, Sep. 7, 1987, T. Akitani, "Recording Material And Production Thereof".

*Primary Examiner*—B. Hamilton Hess

*Attorney, Agent, or Firm*—Oblon, Spivak, McClelland, Maier & Neustadt

[57] ABSTRACT

The present invention provides a recording medium for sublimation type for heat-sensitive transfer recording process which comprises laminated paper as the substrate. In this laminated paper at least two cellulosic fiber papers are bonded together by adhesive agent and one side is coated with a dye accepting layer. Therefore, the recording medium for sublimation type for heat-sensitive transfer recording process which the present invention concerns uses, as the substrate, laminated paper in which cellulosic fiber papers are bonded together. This structure almost completely prevents curling of the recorded medium and also lowers the substrate production cost to achieve a low-cost recording medium and thereby greatly contribute to the expanded use of sublimation type recording printers.

12 Claims, 1 Drawing Sheet

RECORDING MEDIUM FOR SUBLIMATION TYPE HEAT-SENSITIVE TRANSFER RECORDING PROCESS

BACKGROUND OF THE INVENTION (1) Field of the Invention

The present invention relates to a recording medium for a sublimation type heat-sensitive transfer recording process.

(2) Prior Art

Sublimation type heat-sensitive transfer recording process have various advantages, including quiet operation, compactness, low cost, and simple maintenance of the recording device. In addition short output time and high gradation recording is easily achieved by changing the amount of thermal energy on the sublimation disperse dye continuously; and high-density and high-resolution recording is also possible.

With these favorable characteristics, sublimation type heat-sensitive recording method are far more advantageous than any other recording method in production. In particular, it is capable of producing full-color hard copies, and it has been extensively used as the recording method for color printers and video printers.

The recording medium for sublimation type heat-sensitive transfer recording method normally consists of a substrate of cellulosic fiber paper or synthetic paper (mainly polypropylene paper), which is coated with a dye-accepting layer. The above substrate, however, has several disadvantages: it tends to curl after being recorded with heat from the thermal head, thereby degrading the transport characteristics of the recording medium in the printer; the curled print-outs also cause problems with respect to handling and filing.

In an attempt to solve the above problems, laminated paper made of cellulosic fiber paper bonded to synthetic paper has been proposed for the substrate, as disclosed in Japanese Patent Application, first publication No.(-Tokukai Sho) 62-198497. It is, however, still difficult to totally eliminate curling even with this substrate due to the fact that dissimilar materials of different linear thermal expansion coefficients have been laminated together. Another disadvantage is its increased cost due to the use of expensive synthetic paper made of plastics. Other methods have been proposed to prevent curling; Japanese Patent Application, first publication No.(-Tokukai Sho) 63-214484 discloses a substrate of synthetic paper that is lined on the back with a bonded layer of cellulosic fiber paper or plastic film. Japanese Patent Application, first publication No.(Tokukai Hei) 1-44781 discloses a substrate which is coated on the back with thermoplastic resin or a similar material to prevent curling. Each of these substrates, however, tends to be expensive, running counter to the goal of cost reduction.

SUMMARY OF THE INVENTION

An object of the present invention is to provide a recording medium for sublimation type heat-sensitive transfer processes, recording, which causes essentially no curling and is produced at a low cost.

The present invention provides a recording medium for sublimation type for heat-sensitive transfer recording process which comprises laminated paper as the substrate. In this laminated paper at least two cellulosic fiber papers are bonded together by adhesive agent and one side is coated with a dye accepting layer.

Therefore, the recording medium for sublimation type for heat-sensitive transfer recording process which the present invention concerns uses, as the substrate, laminated paper in which cellulosic fiber papers are bonded together. This structure almost completely prevents curling of the recorded medium and also lowers the substrate production cost to achieve a low-cost recording medium and thereby greatly contribute to the expanded use of sublimation type recording printers.

DETAILED DESCRIPTION OF THE PREFERRED EMBODIMENTS

The present invention is described in detail.

Figure 1:
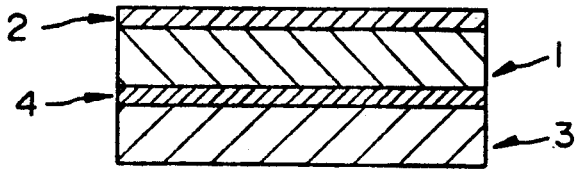
FIG. 1 is a cross section of the structure of the recording medium for a sublimation type heat-sensitive transfer process according to the present invention.

FIG. 1 is a schematic cross section of a structure of the recording medium of the present invention. As shown in this figure, the first cellulosic fiber paper 1 is bonded to the second cellulosic fiber paper 3 via the adhesive layer 4 to form the substrate, which is coated with the dye-accepting layer 2.

The first cellulosic fiber paper 1 on which comes in contact with the dye-accepting layer 2 is not limited to this type of paper, though it must be a plain paper made of cellulose. It is, however, preferable to use paper whose surface is smooth to attain recorded images of acceptable quality. Preferable types of cellulosic fiber paper include art or coated paper. It is also recommended that the thickness of the entire recording medium be in the range of from 50 to 250 μm: a recording medium consisting of excessively thin cellulosic fiber paper will curl to an unacceptable extent, while that of excessively thick cellulosic fiber paper will experience transport problems during operation in the printer.

Material for the second cellulosic fiber paper 3 is not limited; it may be the same as, or different from, that of the first cellulosic fiber paper 1. Its thickness, however, is preferably be determined so as to achieve the proper thickness of the entire recording medium, as described above. Moreover, the back of the second cellulosic fiber paper 3 may be coated with a special layer to improve transport characteristics of the recording medium in the printer, or with an antistatic layer to prevent the accumulation of static electricity while the recording medium is running in the printer.

Figure 2:
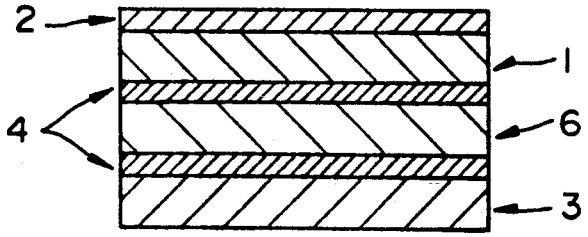
FIG. 2 is a cross section of another structure of the recording medium for a sublimation type heat-sensitive transfer process according to the present invention.

Basically, two cellulosic fiber papers are bonded together to form the substrate. However, the substrate may have a total of three bonded cellulosic fiber papers in which the third cellulosic fiber paper 6 is placed between the first and second cellulosic fiber papers 1 and 3 as illustrated in FIG. 2, in order to secure an adequate thickness of the recording medium, or to further prevent curling of the recorded medium.

Four or more cellulosic fiber papers may be laminated to form the substrate, but it is preferable to limit the number of cellulosic fiber papers to three for reasons of productivity and production cost.

Any adhesive agent may be used for the adhesive layer 4 provided it is normally used for bonding paper or plastic film. However, in view of ease of bonding and elasticity, it is preferred to use adhesives which are conventionally used for dry laminates, for example, urethane type adhesives for dry laminates, such as AD-COAT produced by Toyo-Morton. Furthermore, the adhesive agent is spread over the surface preferably in the range of from 1 to 10 g/m$^2$; an excessively thin adhesive layer is apt to produce poor images, while an excessively thick layer is apt to create an overall recording medium that is unacceptably thick. To reduce curling of the recording medium, it is recommended that when two cellulosic fiber papers 1 and 3 are bonded, a tension exerted on the second cellulosic fiber paper 3 is higher than that on the first cellulosic fiber paper 1, rather than being bonded at the same tension to these papers. It should be noted, however, when the both papers 1 and 3 are bonded the tension exerted on the second cellulosic fiber paper is excessively higher than that on the first paper 1, the recording side will be curved convexly before recording, thus degrading the transport characteristics of the recording medium. The ratio of tension between the first cellulosic fiber paper on which the dye-accepting layer is formed and the second cellulosic fiber paper should be in a range of from 1/1.5 to 1/20 preferably from ½ to 1/17.

When a total of three cellulosic fiber papers 1, 3 and 6 are laminated to form the substrate, the first cellulosic fiber paper 1 on which the dye accepting layer is formed may be first bonded to the third, intermediate, cellulosic fiber paper 6. The second cellulosic fiber paper 3 can then be bonded to the backside of the third cellulosic fiber paper 6. Alternatively, the second cellulosic fiber paper 3 may be first bonded to the third cellulosic fiber paper 6. The first cellulosic fiber paper 1 on which the dye-accepting layer 2 is formed can then be bonded to the third cellulosic fiber paper 6. It is preferable, as is the case when two cellulosic fiber papers are laminated, that the ratio A/B, in which A is the ratio of the tension between the first cellulosic fiber paper 1 and the third cellulosic fiber paper 6 (i.e. tension of the first cellulosic fiber paper 1:tension of the third cellulosic fiber paper 6) and B is the ratio of the tension between the second cellulosic fiber paper 3 and the third cellulosic fiber paper 6 (i.e. tension of the second cellulosic fiber paper 3:the third cellulosic fiber paper 6), is in a range of from 1/1.5 to 1/20, and preferably from ½ to 1/17.

Keeping the lamination tension within the above ratio will achieve a substrate which is remarkably curl-free after recording, even in the case where only cellulosic fiber paper is used.

The dye-accepting layer 2 is formed on one side of the laminated paper which has been prepared as above. It accepts the sublimation-type dye transferred from the transfer sheet, and colors develop. It may accepts dyes well and causes no blocking with ink during the recording process, material for the dye-accepting layer 2 is not limited. The preferrable materials for the dye-accepting layer 2 include, but are not limited to, resins having an ester bond, such as polyester, polyacrylic ester, polycarbonate, polyvinyl acetate, styrene acrylate resin or vinyl toluene acrylate resin; resins having an urethane bond, such as polyurethane; resins having a polyamide bond, such as polyamide (nylon); resins having an urea bond, such as urea; polycaprolactone, styrene-containing resins, polyvinyl chloride, vinyl chloride vinyl acetate copolymer or resin with a highly polar bond, such as polyacrylonitrile; or a mixture thereof, or a copolymer thereof. In addition to the above, resins may contain an inorganic filler, such as silica, calcium carbonate, titanium oxide or zinc oxide, a release agent, and a thermosetting component, such as isocyanate and polyol.

However, as disclosed in Japanese Patent Application, first publications Nos. (Tokukai-Sho) 62-46689 and 63-67188, it is recommended, for reasons of productivity and product quality, that the composition of dye-accepting layer 2 contain a sublimation type disperse dye acceptable resin, a cross-linking agent, and a release agent, the former agent capable of being hardened by an activation energy ray, after having been spread over the substrate. The resin for the dye accepting layer may be of the type described here. The cross-linking agent which can be hardened with an activation energy ray and, which is useful for the present invention includes monomer or oligomer containing an acryloyloxy or a mathacryloyloxy group. The release agent that can be used for the present invention includes a silicone-base or a fluorine-base surface-active agent; graft polymer having polyorganosiloxane in its main or branch chain, or a silicone-base or a fluorine-containing compound capable of forming cross-linked structures, such as a combination of amino-modified and epoxy-modified silicone. One or a combination of two or more of these release agents may be used. The dye-accepting layer 2 of the above composition can readily accept sublimation-type disperse dye, to develop colors that are highly stable and preserve their original brightness after recording.

Figure 3:
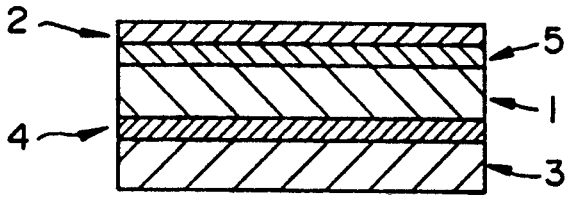
FIG. 3 is a cross section of yet another structure of the recording medium for a sublimation type heat-sensitive transfer process according to the present invention.

The recording medium of the present invention may have an additional layer 5 as shown in FIG. 3, between the dye-accepting layer 2 and the first cellulosic fiber paper 1. This additional layer 5 is used to facilitate bonding, prevent accumulation of static electricity, improve whiteness, or achieve a combination of them.

For example, the material for the additional layer 5, which facilitates bonding, and improves adhesion of the dye-accepting layer 2 to the first cellulosic fiber paper 1, may be selected from various thermoplastic and thermosetting resins, depending on the composition of the dye-accepting layer 2 and the characteristics of the first cellulosic fiber paper 1.

The additional layer 5 can act as an anti-static layer, preventing dust from attaching to the recording medium, and preventing the recording media from sticking to each other as a result of static electricity. Therefore, degradation in transport of the medium through the printer is prevented. Materials useful for the anti-static layer include: an anti-static agent, such as anionic, cathionic, dipolar or non-ionic surface active agent; and an electrically conducting resin, such as polyvinylbenzyl type cathionic resins or polyacrylate-type cathionic resins. The above anti-static agent may be mixed with a binder polymer selected from various types of thermoplastic and thermosetting resins.

The additional layer 5 can also work to improve whiteness of the recording medium. Materials useful for this layer include: white pigment, such as titanium oxide and zinc oxide and/or a fluorescent whiteness improver, mixed with a binder polymer selected from various thermoplastic and thermosetting resins.

This additional layer 5 may be of a composite layer, exhibiting two or more functions as described above. This composite layer is formed by spreading the composition containing two or more of the above-described anti-static agents, a whiteness-improving pigment, a fluorescent-whiteness improver and/or the others, mixed in a binder polymer selected from various thermoplastic and thermosetting resins.

EXAMPLES

The present invention will be more clearly understood by referring to the following examples. The term "part" described in EXAMPLES and COMPARATIVE EXAMPLES means "part by weight."

* Preparation of the Substrate

SUBSTRATES 1 through 14

Two sheets of cellulosic fiber paper were bonded together, to prepare each of SUBSTRATES 1 through 14; the type of sheet and bonding tension for each substrate is given in Table 1. The adhesive agent used was urethane-base adhesive agent Toyo Morton's AD-COAT (trade name) consisting of two liquid adhesives, AD-577-1 and CAT-52. It was spread at 5 g/m$^2$ (dry basis) over the surface, dried at 80° C. for approximately 30 seconds, and aged at 40° C. for 3 days.

SUBSTRATES 15 through 20

Three sheets of cellulosic fiber paper were bonded together, to prepare each of SUBSTRATES 15 through 20; the type of sheet and bonding tension for each substrate is given in Table 2. The first cellulosic fiber paper on which the dye-accepting layer was to be placed was bonded to the third cellulosic fiber paper, and the second cellulosic fiber paper was bonded on the backside of the third cellulosic fiber paper. The adhesive agent used consisted of Toyo Morton's AD-577-1 and CAT-52. It was spread at 5 g/m$^2$ (dry basis) over the surface, dried at 80° C. for approximately 30 seconds, and aged at 40° C. for 3 days.

SUBSTRATE 21

Art paper (weight: 209.3 g/m$^2$, thickness: approximately 180 μm) was used singly for the substrate.

SUBSTRATE 22

Synthetic paper of polypropylene (thickness: approximately 200 μm), supplied by Oji-Yuka Synthetic Paper Co. Ltd., was used singly for the substrate.

EXAMPLE 1 TO 20, COMPARATIVE EXAMPLES 1 and 2

Each of the SUBSTRATE 1 to 22 was dipped in and uniformly covered with the coating solution given in Table 3. Each of the substrate 1 to 22 was then irradiated in air with ultraviolet rays emitted from a high-pressure mercury lamp, to form the 5 to 6 μm-thick dye-accepting layer.

An image was recorded on the recording medium thus prepared using a video printer (Mitsubishi Electric's SCT-CP100). The color sheet (ink sheet) used was SCT-CK100TS provided for the above equipment.

The extent of curling of the recorded medium was determined by placing it on the flat surface of a desk and measuring the warp height at the four corners. The average value was reported for each recording medium, as shown in Table 4.

EXAMPLE 21

A 10% methanol solution of N-lauryl pyridinium chloride was spread over SUBSTRATE 7, described in Table 1, by a bar coater, and dried to form a uniform coating film. The same coating solution as used in EXAMPLE 1 was used to form the dye-accepting layer.

The same procedure as used in EXAMPLE 1 was repeated to assess the recording medium thus prepared. The results are given in Table 4.

EXAMPLE 22

The following composition was spread over SUBSTRATE 7, described in Table 1, by a wire bar, and dried to form a 10 μm, uniformly coated film. Then, the coating solution described in Table 3 was used to form the dye-accepting layer, in the same manner as used in EXAMPLE 1. The same procedure as used in EXAMPLE 1 was repeated to assess the recording medium thus prepared The results are given in Table 4.

| | |
|---|---|
| Copolymer of methyl methacrylate/ethyl acrylate/methacrylic acid (84/13/3) (weight-average molecular weight: approximately 90,000) | 16 parts by weight |
| Titanium oxide (Titanium Kogyo's KA-10) | 4 parts by weight |
| Methylethylketone | 80 parts by weight |

The results given in Table 4 show that the recording medium of the present invention for sublimation type heat-sensitive transfer recording processes, which is characterized by achieving a reduced curling after recording, can be formed by the simple and convenient method of laminating only sheets of cellulosic fiber paper to prepare the substrate.

TABLE 1

| | First Cellulosic Fiber Paper 1*1 | | | Second Cellulosic Fiber Paper 3*2 | | | |
|---|---|---|---|---|---|---|---|
| substrate | Types | Weight (g/m$^2$) | Tension (kg/m) | Types | Weight (g/m$^2$) | Tension (kg/m) | Thickness (mm) |
| 1 | Art Paper | 104.7 | 4 | Art Paper | 104.7 | 4 | 180 |
| 2 | Art Paper | 104.7 | 4 | Art Paper | 104.7 | 10 | 180 |
| 3 | Art Paper | 104.7 | 4 | Art Paper | 84.9 | 10 | 160 |
| 4 | Art Paper | 84.9 | 4 | Art Paper | 104.7 | 10 | 160 |
| 5 | Art Paper | 104.7 | 4 | Art Paper | 104.7 | 30 | 180 |
| 6 | Art Paper | 104.7 | 4 | Art Paper | 84.9 | 30 | 160 |
| 7 | Art Paper | 84.9 | 4 | Art Paper | 104.7 | 30 | 160 |
| 8 | Art Paper | 104.7 | 4 | Art Paper | 104.7 | 60 | 180 |
| 9 | Art Paper | 104.7 | 4 | Art Paper | 84.9 | 60 | 160 |
| 10 | Art Paper | 84.9 | 4 | Art Paper | 104.7 | 60 | 160 |
| 11 | Art Paper | 104.7 | 3 | Art Paper | 104.7 | 75 | 180 |
| 12 | Coated Paper | 104.7 | 4 | Coated Paper | 104.7 | 30 | 180 |
| 13 | Coated Paper | 84.9 | 4 | Art Paper | 104.7 | 30 | 160 |
| 14 | Art Paper | 104.7 | 4 | High Quality | 104.7 | 30 | 180 |

TABLE 1-continued

| substrate | First Cellulosic Fiber Paper 1*1 Types | Weight ($g/m^2$) | Tension (kg/m) | Second Cellulosic Fiber Paper 3*2 Types | Weight ($g/m^2$) | Tension (kg/m) | Thickness (mm) |
|---|---|---|---|---|---|---|---|
| | | | | Paper | | | |

*1The dye-accepting layer side
*2Backside

TABLE 2

| SUB-STRATE | First Cellulosic Fiber Paper 1 (on the dye-accepting) layer side) Types | Weight ($g/m^2$) | Tension (kg/m) | Third Cellulosic Fiber Paper 6 Types | Weight ($g/m^2$) | Tension 1 (kg/m) | Tension 2 (kg/m) | Second Cellulosic Fiber Paper 3 (back side) Types | Weight ($g/m^2$) | Tension (kg/m) | Thickness (μm) |
|---|---|---|---|---|---|---|---|---|---|---|---|
| 15 | Coated Paper | 73.3 | 4 | Coated Paper | 73.3 | 20 | 20 | Coated Paper | 73.3 | 10 | 190 |
| 16 | Coated Paper | 73.3 | 4 | Coated Paper | 73.3 | 20 | 20 | Coated Paper | 73.3 | 30 | 190 |
| 17 | Coated Paper | 73.3 | 4 | Coated Paper | 73.3 | 20 | 20 | Coated Paper | 73.3 | 60 | 190 |
| 18 | Art Paper | 84.9 | 4 | Art Paper | 84.9 | 20 | 20 | Art Paper | 84.9 | 20 | 210 |
| 19 | Art Paper | 84.9 | 4 | Coated Paper | 60.2 | 20 | 20 | Coated Paper | 60.2 | 20 | 185 |
| 20 | Coated Paper | 60.2 | 4 | High-Quality Paper | 81.4 | 20 | 20 | Coated Paper | 60.2 | 20 | 185 |

Tension 1: Tension at which the first cellulosic fiber paper 1 is bonded.
Tension 2: Tension at which the second cellulosic fiber paper 3 is bonded.

TABLE 3

| Ingredients | | Parts by Weight |
|---|---|---|
| Crosslinking agent | 2P6A*1 | 3 |
| | 2P5A*2 | 4 |
| | 2P4A*3 | 3 |
| | A-DEP*4 | 10 |
| Polyester resin | Resin A*5 | 60 |
| | Resin B*6 | 20 |
| Photopolymerization initiator | 1-hydroxycyclohexyl phenyl ketone | 5 |
| Silicone-base surface active agent*7 | | 0.1 |
| Solvent | methyl ethyl ketone | 400 |
| | toluene | 100 |

*12P6A: dipentaerythritol hexaacrylate
*2265A: dipentaerythritol pentaacrylate
*3264A: dipentaerythritol tetraacrylate
*4A-DEP: 2,2-bis (4-acyloyloxy diethoxyphenyl) propane
*5Polyester resin A: Resin produced by condensing/polymerizing terephthalic acid/isophthalic acid/sebacic acid/ethylene glycol/neopentyl glycol (molecular weight: 20,000 to 25,000, Tg: 10° C.)
*6Polyester resin B: Resin produced by condensing/polymerizing terephthalic acid/isophthalic acid/sebacic acid/ethylene glycol/neopentyl glycol/1,4-butane diol (molecular weight: 20,000 to 25,000, Tg: 47° C.)
*7Silicon-base surface active agent

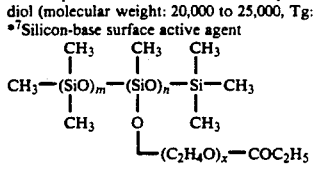

$$\frac{2m + n + 1}{nx} = 1.3$$

TABLE 4

| No. | SUB-STRATE | Recording Density (OD level) *1 | Extent of curling *2 |
|---|---|---|---|
| EXAMPLE 1 | 1 | 2.55 | 15 |
| EXAMPLE 2 | 2 | 2.55 | 11 |
| EXAMPLE 3 | 3 | 2.49 | 13 |
| EXAMPLE 4 | 4 | 2.53 | 12 |
| EXAMPLE 5 | 5 | 2.54 | 8 |
| EXAMPLE 6 | 6 | 2.50 | 10 |
| EXAMPLE 7 | 7 | 2.53 | 11 |

TABLE 4-continued

| No. | SUB-STRATE | Recording Density (OD level) *1 | Extent of curling *2 |
|---|---|---|---|
| EXAMPLE 8 | 8 | 2.55 | 10 |
| EXAMPLE 9 | 9 | 2.43 | 9 |
| EXAMPLE 10 | 10 | 2.45 | 10 |
| EXAMPLE 11 | 11 | 2.54 | 16 |
| EXAMPLE 12 | 12 | 2.55 | 9 |
| EXAMPLE 13 | 13 | 2.53 | 10 |
| EXAMPLE 14 | 14 | 2.55 | 10 |
| EXAMPLE 15 | 15 | 2.56 | 10 |
| EXAMPLE 16 | 16 | 2.57 | 8 |
| EXAMPLE 17 | 17 | 2.55 | 9 |
| EXAMPLE 18 | 18 | 2.58 | 8 |
| EXAMPLE 19 | 19 | 2.55 | 11 |
| EXAMPLE 20 | 20 | 2.57 | 12 |
| EXAMPLE 21 | 7 | 2.54 | 11*3 |
| EXAMPLE 22 | 7 | 2.60 | 7*4 |
| COMPARATIVE EXAMPLE 1 | 21 | 1.86 | 20 |
| COMPARATIVE EXAMPLE 2 | 22 | 2.60 | 46 |

*1Kyocera's thermal head (6 dots/mm) was used.
The color sheet used was Mitsubishi Electric's SCT-CK100TS (cyanine)
Recording voltage: 13V, Pulse width: 20 ms
Measurement of recording density: Macbeth optical densitometer TR-927
Density of reflected light transmitted through a Status A filter was measured using TR-927.
*2A black image was recorded over the entire surface of the recording medium, using a Mitsubishi Electric's video printer CP-100. "Extent of curling" is the average warp height at the four corners of the recorded medium (mm)
*3Quantity of dust attached by static electricity is smaller.
*4Brighter whiteness.

What is claimed is:

1. A recording medium for sublimation type heat-sensitive transfer recording process comprising a substrate and a dye-accepting layer on one surface of the substrate, wherein the substrate comprises a laminate paper, and wherein the laminate paper consists of two sheets of cellulosic fiber paper bonded together by an adhesive agent and further wherein one of the sheets of cellulosic fiber paper, on a surface of the substrate on which the dye-accepting layer is not formed, has a tension which is 1.5 to 20 times higher than the tension of the other sheet of cellulosic fiber paper which is on a surface of the substrate on which the dye-accepting layer is formed.

2. A recording medium for sublimation type heat-sensitive transfer recording process as claimed in claim 1, wherein the quantity of the adhesive agent in the laminate paper is in the range of from 1 to 10 g/m$^2$.

3. A recording medium for sublimation type heat-sensitive transfer recording process as claimed in claim 1, wherein the thickness of the recording medium is in a range of from 50 to 250 $\mu$m.

4. A recording medium for sublimation type heat-sensitive transfer recording process as claimed in claim 1, wherein the dye-accepting layer contains a sublimation dye acceptable resin, an activation energy ray hardenable cross-linking agent, and a release agent.

5. A recording medium for sublimation type heat-sensitive transfer recording process as claimed in claim 1, wherein one of the sheets of cellulosic fiber paper, on which the dye-accepting layer is to be formed, is a coated paper.

6. A recording medium for sublimation type heat-sensitive transfer recording process as claimed in claim 1, wherein one of the sheets of cellulosic fiber paper, on which the dye-accepting layer is to be formed, is art paper.

7. A recording medium for sublimation type heat-sensitive transfer recording process comprising a substrate and a dye-accepting layer on one surface of the substrate, wherein the substrate comprises a laminate paper comprising three sheets of cellulosic fiber paper, i.e., upper, intermediate, lower, bonded together by an adhesive agent, and wherein the tension exerted on the cellulosic fiber papers when they are bonded to one another have the following relationship: $1/1.5 \leqq A/B \leqq 1/20$ wherein: A is the ratio of tension between one of the sheets of cellulosic fiber paper on which the dye-accepting layer is formed and the intermediate paper, B is the ratio of tension between one of the sheets of cellulosic fiber paper on which the dye-accepting layer is not formed and the intermediate paper.

8. A recording medium for sublimation type heat-sensitive transfer recording process as claimed in claim 7, wherein the quantity of the adhesive agent in the laminate paper is in the range of from 1 to 10 g/m$^2$.

9. A recording medium for sublimation type heat-sensitive transfer recording process as claimed in claim 7, wherein the thickness of the recording medium is in a range of from 50 to 250 $\mu$m.

10. A recording medium for sublimation type heat-sensitive transfer recording process as claimed in claim 7, wherein the dye-accepting layer contains a sublimation dye acceptable resin, an activation energy ray hardenable cross-linking agent, and a release agent.

11. A recording medium for sublimation type heat-sensitive transfer recording process as claimed in claim 7, wherein one of the sheets of cellulosic fiber paper, on which the dye-accepting layer is to be formed, is a coated paper.

12. A recording medium for sublimation type heat-sensitive transfer recording process as claimed in claim 7, wherein one of the sheets of cellulosic fiber paper, on which the dye-accepting layer is to be formed, is art paper.

* * * * *